US009694831B2

(12) United States Patent
Kreuzweger et al.

(10) Patent No.: US 9,694,831 B2
(45) Date of Patent: Jul. 4, 2017

(54) DEVICE FOR TRANSMITTING A FORCE BETWEEN THE CHASSIS AND BODY OF A RAIL VEHICLE

(71) Applicant: SIEMENS AG OESTERREICH, Vienna (AT)

(72) Inventors: David Kreuzweger, Graz (AT); Christian Plankensteiner, Doelsach (AT); Michael Sumnitsch, Graz (AT)

(73) Assignee: SIEMENS AG OESTERREICH, Vienna (AT)

( * ) Notice: Subject to any disclaimer, the term of this patent is extended or adjusted under 35 U.S.C. 154(b) by 150 days.

(21) Appl. No.: 14/396,772

(22) PCT Filed: Apr. 4, 2013

(86) PCT No.: PCT/EP2013/057105

§ 371 (c)(1),
(2) Date: Oct. 24, 2014

(87) PCT Pub. No.: WO2013/160079

PCT Pub. Date: Oct. 31, 2013

(65) Prior Publication Data

US 2015/0144026 A1 May 28, 2015

(30) Foreign Application Priority Data

Apr. 26, 2012 (AT) ..... A 50147/2012

(51) Int. Cl.

| | |
|---|---|
| ***B61F 5/00*** | (2006.01) |
| ***B61F 5/02*** | (2006.01) |
| ***B61F 5/08*** | (2006.01) |

(52) U.S. Cl.
CPC . *B61F 5/02* (2013.01); *B61F 5/08* (2013.01)

(58) Field of Classification Search
CPC ..... B61F 5/02–5/12
See application file for complete search history.

(56) References Cited

U.S. PATENT DOCUMENTS 1,959,704 A * 5/1934 Bugatti ..... B61F 5/16 105/171
2,499,087 A * 2/1950 Bourdon ..... B61F 5/16 105/193

(Continued)

FOREIGN PATENT DOCUMENTS

BE 665271 A 12/1965
DE 939932 C 3/1956

(Continued)

*Primary Examiner* — Jason C Smith
(74) *Attorney, Agent, or Firm* — Laurence Greenberg; Werner Stemer; Ralph Locher

(57) ABSTRACT

A device transmits a force between a chassis and a body of a rail vehicle. The device is a structurally simple, space-saving device which allows spring movements and rotational movements of the body relative to the chassis. This is achieved in that at least one first traction link buffer, which has a first end face, and at least one second traction link buffer, which has a second end face, are fixed to the chassis. The first end face is spaced from the second end face in a longitudinal direction of the rail vehicle. The two end faces point in at least approximately opposite directions, and a stop plate with sliding portions which are mutually spaced in the longitudinal direction is provided on the body. The end faces of the traction link buffers rest against the sliding portions in a slidable manner at least along some sections.

10 Claims, 3 Drawing Sheets

(56) References Cited

U.S. PATENT DOCUMENTS

| | | | | | |
|---|---|---|---|---|---|
| 3,570,408 | A * | 3/1971 | Lich | B61F 3/04 | 105/133 |
| 3,774,550 | A * | 11/1973 | Lich | B61F 5/16 | 105/182.1 |
| 4,094,253 | A * | 6/1978 | Gage | B61F 5/32 | 105/221.1 |
| 2012/0240813 | A1* | 9/2012 | Becher | B61F 5/52 | 105/157.1 |
| 2015/0144026 | A1* | 5/2015 | Kreuzweger | B61F 5/08 | 105/453 |

FOREIGN PATENT DOCUMENTS

| | | | |
|---|---|---|---|
| DE | 1009217 | B | 5/1957 |
| DE | 1605074 | A1 | 3/1971 |
| DE | 2313887 | A1 | 10/1973 |
| FR | 2240852 | A1 | 3/1975 |
| FR | 2341450 | A1 | 9/1977 |
| GB | 986376 | A | 3/1965 |
| GB | 1080769 | A | 8/1967 |
| GB | 1569354 | A | 6/1980 |
| RU | 2276030 | C1 | 5/2006 |
| SU | 123183 | A1 | 11/1959 |
| SU | 491504 | A1 | 11/1975 |
| WO | 9214537 | A1 | 9/1992 |

* cited by examiner

DEVICE FOR TRANSMITTING A FORCE BETWEEN THE CHASSIS AND BODY OF A RAIL VEHICLE

AREA OF INVENTION

The invention relates to a device for transmitting a force between a chassis and a body of a rail vehicle linked with the chassis.

PRIOR ART

In rail vehicles the chassis and body are connected to each other on the one hand via a secondary suspension, in order to enable a spring movement or a spring compression and extension of the body especially in a vertical direction, but also in a lateral direction, in particular parallel to a transverse direction. The secondary suspension is however not suitable for the traction link of the chassis, that is for transmitting a force between chassis and body parallel to a longitudinal direction, which is necessary for the acceleration and braking of the body by the chassis. Accordingly a device for traction link is on the other hand necessary, which connects chassis and body to each other and at the same time permits spring movements and turning movements of the body relative to the chassis, such as arise for example when negotiating a curve.

Complex solutions for meeting these requirements with bearing links, center pivots, lemniscate links and combinations of these elements are known from the prior art. EP 1254821 A1 provides an example of this, in which body and chassis are connected to each other via a lemniscates link.

A disadvantage of the known solutions is that—besides the considerable technical effort, which permits only minimal manufacturing tolerances—a relatively large structural space is usually required, space which is then no longer available for the other elements, such as for example dampers and/or roll stabilizers. In addition the lifting of the body from the chassis proves to be complicated, as many connecting elements of the known traction link devices must be loosened. The accessibility of these connecting elements is generally very restricted, which renders checking difficult.

Problem of the Invention

The problem of the present invention is to avoid the aforementioned disadvantages. In particular a structurally simple device for transmitting a force in longitudinal direction is to be created, which permits spring movements and rotational movements of the body relative to the chassis. In addition, the device should take up little structural space and facilitate an uncomplicated release of the body from the chassis. Finally, it must be possible simply to balance out manufacturing tolerances and the device readily accessible for checking purposes.

SUMMARY OF THE INVENTION

According to the invention this problem is solved with a device as claimed in claims 1 to 10. The core of the invention is the arrangement of traction link buffers on at least one crossmember of a chassis, which traction link buffers are abutted by sliding portions of a stop plate, which is fixed to a body or part of the same, in a slidable manner. Here, the sliding portions abut end faces of the traction link buffers, wherein the end faces are preferably normally located in a longitudinal direction of the chassis and face in opposite directions. Force between the chassis and the body can hereby be transmitted parallel to the longitudinal direction, that is to say a traction link can be realized, without the sliding portions having to be laboriously fixed to the traction link buffers. Instead, the sliding portions abut the traction link buffers or their end faces in a slidable manner, so that spring movements between chassis and body by means of a secondary suspension are enabled without hindrance. That is to say the secondary suspension represents the suspension between body and chassis.

The spring movements give rise to a sliding of the sliding portions on the traction link buffers or their end faces. The sliding can here take place both parallel to a vertical direction and parallel to a transverse direction, wherein longitudinal direction, vertical direction and transverse direction are preferably normally reciprocally dependent. In addition, removal of the body from the chassis is hereby enabled, without connections having to be released because of the traction link. Finally, the thus realized traction link can be viewed from beneath, looking vertically upwards, and thus enables monitoring of the associated components.

Accordingly, in the case of a device for transmitting a force between a chassis and a body of a rail vehicle, it is provided that, according to the invention, at least a first traction link buffer having a first end face and at least a second traction link buffer having a second end face are fixed to the chassis, that the first end face is at a distance from the second end face in relation to a longitudinal direction of the rail vehicle, that the two end faces face in at least approximately opposite directions and that provided on the body is a stop plate with sliding portions mutually spaced in the longitudinal direction, which the end faces of traction link buffer abut at least in sections in a slidable manner.

Viewed in the longitudinal direction the chassis preferably has at least two axles arranged one after the other with in each case two wheels and at least one crossmember extending in the transverse direction. A particularly space-saving embodiment emerges if the traction link buffers are fixed to the same crossmember, so that viewed in the longitudinal direction, at least one traction link buffer is arranged in front of and behind the crossmember in each case, wherein the end faces of the traction link buffer in front of and behind the crossmember face in opposite directions parallel to the longitudinal direction. The stop plate is correspondingly in the form of a fork, embodied with limbs, wherein the limbs are at a distance from each other in the longitudinal direction and in each case have a sliding portion facing an end face. The sliding portions of the limbs mutually spaced in a longitudinal direction correspondingly face each other, wherein the traction link buffer and the crossmember are located between these sliding portions.

Thus in a preferred embodiment of the inventive device it is provided that the at least one first traction link buffer and the at least one second traction link buffer are fixed to a crossmember of the chassis, and that the stop plate is embodied in the form of a fork and comprises limbs with in each case a sliding portion facing an end face.

According to the aforementioned spring movements parallel to the vertical direction and/or transverse direction, in the case of a particularly preferred embodiment of the inventive device it is provided that the sliding portions are movable parallel to a vertical direction and/or to a transverse direction. The suspension travel parallel to the vertical direction is here limited by the secondary suspension. The suspension parallel to the transverse direction likewise takes place via the secondary suspension, although the suspension travel is hereby limited by a transverse stop, which is generally arranged in the area of the secondary suspension.

In order to allow the sliding of the sliding portions on the end faces to proceed in a particularly low-friction manner, in the case of a particularly preferred embodiment of the inventive device it is provided that a slide plate with a slide surface is fixed on each end face respectively in replaceable manner. In light of this replaceability, which is preferably realized by screwing together the slide plates and the traction link buffers, the slide plates can be designed as low-cost consumables. In this case the sliding portions are designed to be wear-resistant, so that only the slide plates must be renewed. Finally, the friction between slide plate and sliding portion can be selectively influenced through the choice of the material for the slide plate.

In a particularly cost-effective embodiment of the inventive device it is provided that the slide plates are manufactured from plastic.

In order to make available a maximum slide surface for an optimum transmission of force in the case of a prescribed constructional space or volume, in a particularly preferred embodiment of the inventive device it is provided that viewed in the longitudinal direction the slide plates are circular in form.

In order on the one hand to guarantee an optimum transmission of force between chassis and body and on the other to be able to design a chassis with just a simple crossmember—thus saving materials and costs—in a particularly preferred embodiment of the inventive device it is provided that the crossmember with the first and second traction link buffers attached thereto is arranged centrally in the chassis with reference to the longitudinal direction of the rail vehicle.

The traction link buffers must be manufactured from an elastic material. In order to save costs, in a particularly preferred embodiment of the inventive device it is provided that the at least one first traction link buffer and/or the at least one second traction link buffers take the form of multilayer elastomer buffers.

By means of the elastic traction link buffers not only are braking and acceleration movements damped, but—damped and limited—rotational movements of the body relative to the chassis are enabled. Accordingly, in a particularly preferred embodiment of the inventive device it is provided that the body with the stop plate is rotatable relative to the chassis about an axis of rotation which extends parallel to the vertical direction.

In order to be able to fix a traction link buffer to a crossmember, the traction link buffers have a base plate. This can be screwed to the crossmember. An adjustment insert can here be arranged between the crossmember and the base plate, so that manufacturing tolerances can be readily balanced. A flat abutment of the sliding portions on each traction link buffer can thus be guaranteed. On the other hand a defined gap between chassis and body or between the end face of the respective traction link buffers and the respective sliding portion can be set via the adjustment insert. Accordingly in a particularly preferable embodiment of the inventive device it is provided that the traction link buffers have a base plate and are fixed to the same by screwing the base plate to a crossmember, wherein at least one adjustment insert is arranged between the crossmember and the respective base plate.

BRIEF DESCRIPTION OF THE FIGURES

The invention will now be explained in greater detail on the basis of an exemplary embodiment. The drawings are by way of example and, while intended to set out the inventive concept, they in no way constrain or definitively reflect it.

Wherein.

WAYS OF CARRYING OUT THE INVENTION

Figure 1:
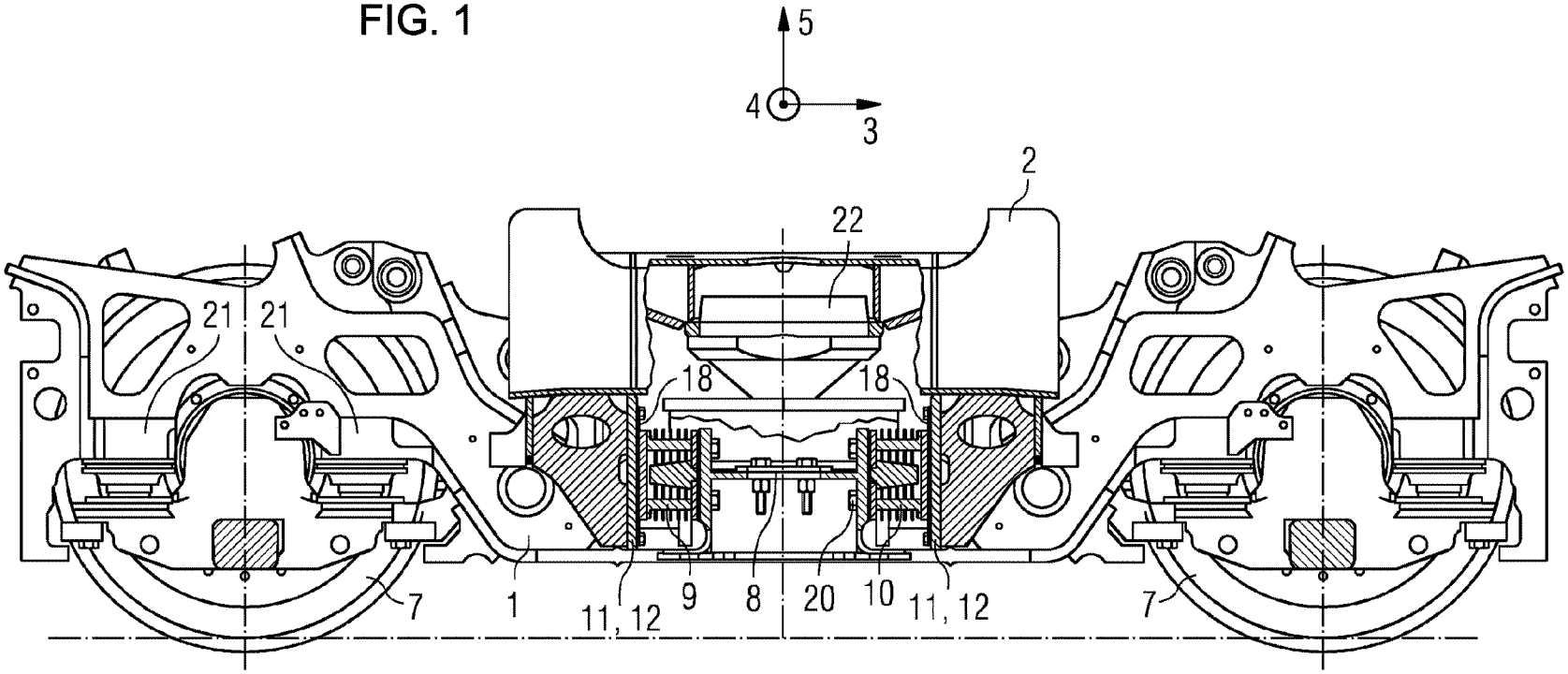
FIG. 1 shows a sectional view of a chassis and of part of a body according to the intersecting line A-A in FIG. 2
Figure 2:
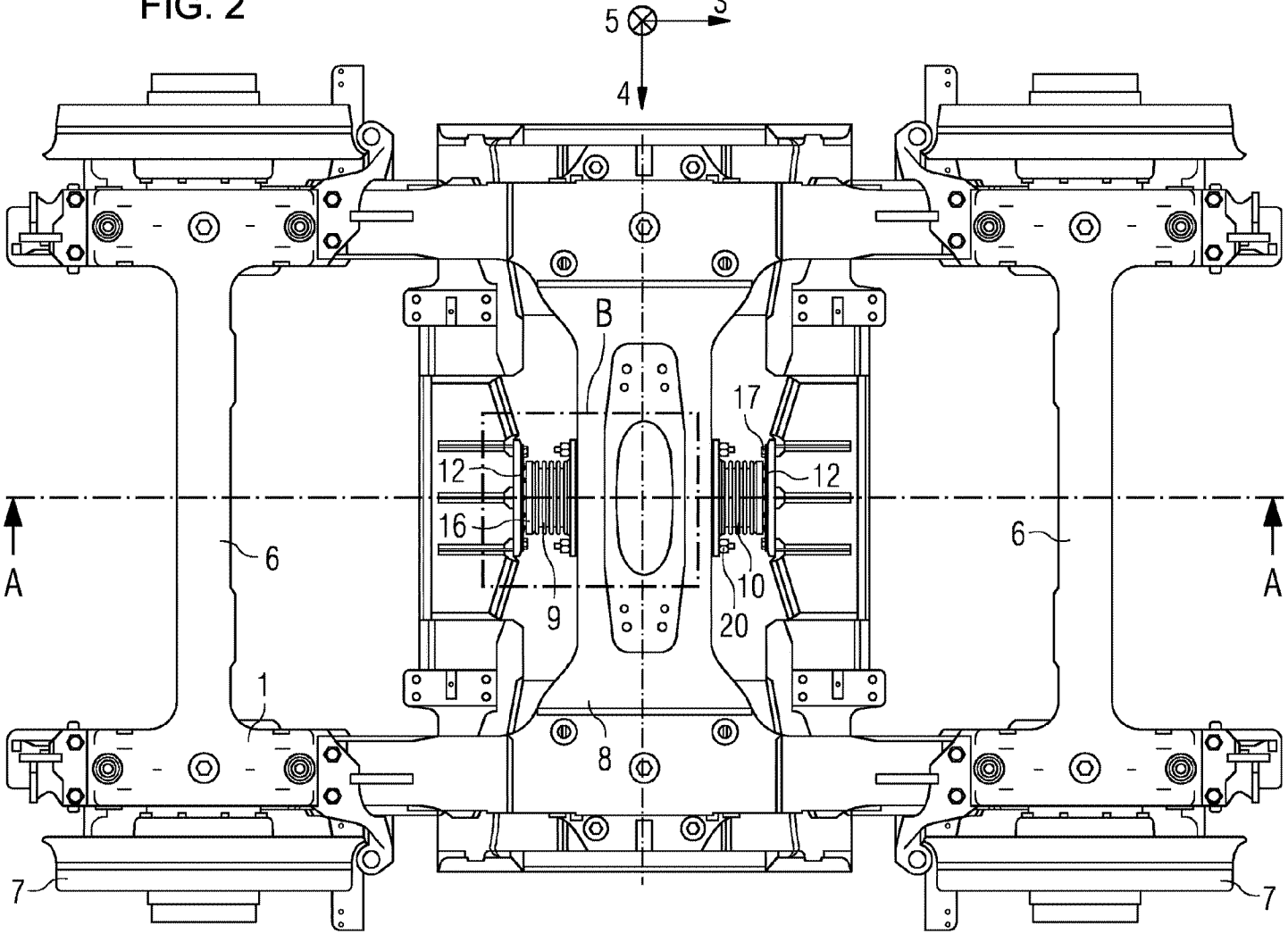
FIG. 2 shows a view of the underside of a chassis of a rail vehicle

FIG. 1 shows a sectional view of a chassis 1 of a rail vehicle according to the intersecting line A-A in FIG. 2. The chassis 1 here comprises two axles 6, which are at a distance from each other in a longitudinal direction 3 and upon which are mounted in each case two wheels 7. The chassis 1 further has a crossmember 8, which extends in a transverse direction 4, which is normally located on the longitudinal direction 3 and in a vertical direction 5. Although the chassis 1 shown comprises no traction elements, the inventive device can of course also be provided for traction chassis in an analogous manner.

Fixed onto the crossmember 8 are a first traction link buffer 9 and a second traction link buffer 10. Viewed in a longitudinal direction, the first traction link buffer 9 is here arranged before the crossmember 8 and the second traction link buffer 10 after crossmember 8. The traction link buffers 9, 10 take the form of multilayer elastomer buffers which are known per se, which have a corresponding elasticity.

Figure 3:
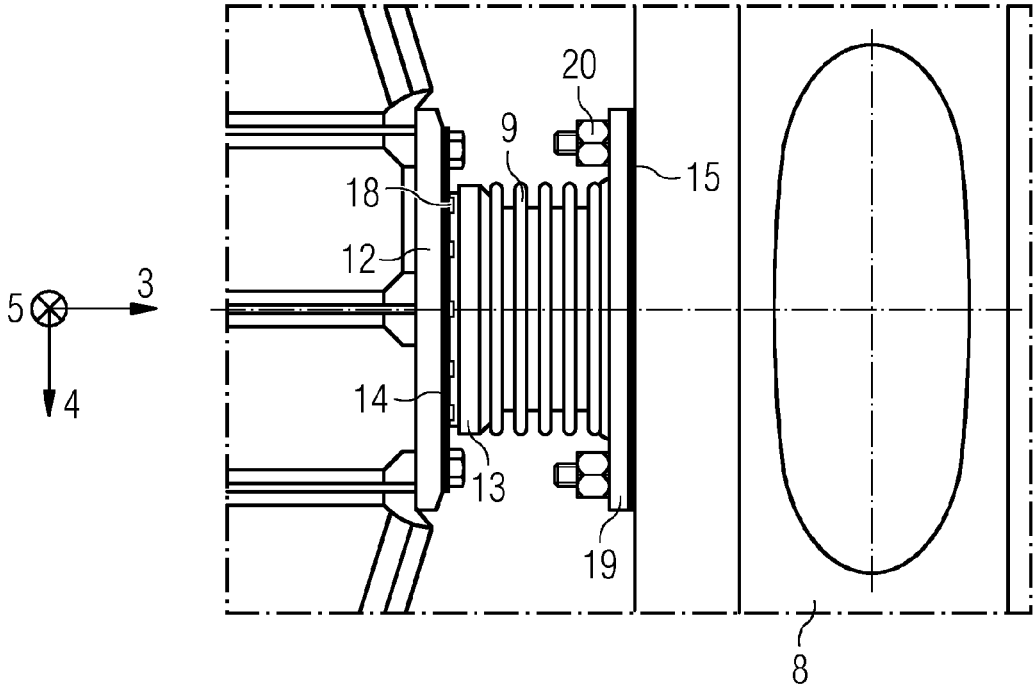
FIG. 3 shows an enlarged detailed view of the area B from FIG. 2

Viewed in longitudinal direction 3, the traction link buffers 9, 10 have in each case at one end a base plate 19, which is fixed to the crossmember 8 by means of screw connections 20, cf. FIG. 3, which shows an enlarged detailed view of the area B from FIG. 2. On the respective other end viewed in longitudinal direction 3, the traction link buffers 9, 10 in each case have an end face 16, 17, which extends along the transverse direction 4 and the vertical direction 5. The end face 16 of the first traction link buffers 9 and the end face 17 of the second traction link buffers 10 here face in opposite directions and away from each other.

A slide plate 13 with a slide surface 14 is fixed to each end face 16, 17 respectively, wherein the slide surfaces 14 extend along the transverse direction 4 and vertical direction 5. The slide plates 13 are designed as consumables and manufactured from plastic. A sliding portion 18 of a limb 12 of a stop plate 11 in each case abuts the slide surfaces 14 in a flat and slidable manner, wherein the sliding portions 18 are embodied to be wear-resistant. The limbs 12 are in at a distance from each other in longitudinal direction 3, so that seen in transverse direction 4 the stop plate 11 is embodied in fork-like form.

The stop plate 11 is in turn fixedly connected to a body 2, of which part can be seen in FIG. 1. The body 2 is further coupled with the chassis 1 by means of a secondary suspension 22. The axles 6 with the wheels 7 are in addition coupled with the chassis 1 by means of a primary suspension 21.

In order to enable flat abutment of the sliding portions 18 of the limbs 12 on the slide surfaces 14 of the slide plates 13, adjustment inserts 15 are arranged between crossmember 8 and the base plates 19. In this way, manufacturing tolerances can be taken into account without problems. On the other hand a defined gap between chassis 1 and body 2 or between the slide surfaces 14 of the slide plates 13 and the sliding portions 18 can also be set by means of the adjustment inserts 15.

As can be seen in FIG. 2, the area of the traction link buffers 9, 10 and the sliding portions 18 of the limbs 12 can be inspected from beneath in the vertical direction. This enables unproblematic monitoring of the device, for example in order to ascertain the state of wear of the slide plates 13. It is further evident from FIG. 2 that the inventive device, which only requires a simple crossmember 8, leaves abundant space for other components, such as for example dampers (not shown) for the secondary suspension 22 or roll stabilizers (not shown).

As the sliding portions 18 are not rigidly connected with the slide surfaces 14 of the slide plates 1, but merely abut them in a slidable manner, the sliding portions 18 slide on the slide surfaces 14 in the case of spring movements of the body 2 relative to the chassis 1. That is the body 2 can, without problem, perform spring movements relative to the chassis 1 parallel to the vertical direction 5 and parallel to the transverse direction 4 by means of the secondary suspension 22. The suspension travel is here limited in the vertical direction 5 by the secondary suspension 22 and in the transverse direction by corresponding stops (not shown).

At the same time, the flat abutment of the sliding portions 18 with the slide plates 13 guarantees optimal transmission of force parallel to the longitudinal direction 3, that is to say guarantees positive and negative accelerations parallel to the longitudinal direction 3. A certain degree of jerk damping is hereby achieved by means of the damping of the elastomer of the traction link buffers 9, 10.

Finally, the elasticity of the traction link buffers 9, 10 also enables angularly limited rotational movements of the body 2 relative to the chassis 1, wherein a corresponding axis of rotation lies parallel to the vertical direction 5 and preferably in the center of the chassis. In this case too, the damping of the elastomer of the traction link buffers 9, 10 effects a certain degree of jerk damping.

LIST OF REFERENCE CHARACTERS

1 Chassis
2 Body
3 Longitudinal direction
4 Transverse direction
5 Vertical direction
6 Axle
7 Wheel
8 Crossmember
9 First traction link buffer
10 Second traction link buffer
11 Stop plate
12 Limbs of the stop plate
13 Slide plate
14 Slide surface
15 Adjustment insert
16 End face of the first traction link buffer
17 End face of the second traction link buffer
18 Sliding portion
19 Base plate
20 Screw connection
21 Primary suspension
22 Secondary suspension

The invention claimed is:

1. A device for transmitting a force between a chassis and a rail car body of a rail vehicle, the device comprising:

traction link buffers including at least one first traction link buffer having a first end face and at least one second traction link buffer having a second end face fixed to the chassis, the chassis and the rail car body being separate components of the rail vehicle, said first end face disposed at a distance from said second end face in relation to a longitudinal direction of the rail vehicle, said first and second end faces face in at least approximately opposite directions; and a stop plate disposed on the rail car body and having mutually spaced sliding portions in the longitudinal direction, said first and second end faces of said traction link buffers abut at least in sections in a slidable manner with said sliding portions for transmitting forces in the longitudinal direction of the rail vehicle between the chassis and the rail car body.

2. The device according to claim 1, wherein:

said at least one first traction link buffer and said at least one second traction link buffer are fixed to a cross-member of the chassis; and said stop plate is a fork having limbs with, in each case, one of said sliding portions facing one of said first or second end faces.

3. The device according to claim 2, wherein the cross-member with the first and second traction link buffers attached thereto is disposed centrally in the chassis with reference to the longitudinal direction of the rail vehicle.

4. The device according to claim 1, wherein said sliding portions are movable parallel to a vertical direction and/or to a transverse direction.

5. The device according to claim 1, further comprising slide plates each having a slide surface, in each case one of said slide plates with said slide surface fixed to one of said first or second end faces in a replaceable manner.

6. The device according to claim 5, wherein said slide plates are manufactured from plastic.

7. The device according to claim 5, wherein said slide plates have a circular form, seen in the longitudinal direction.

8. The device according to claim 1, wherein said at least one first traction link buffer and/or said at least one second traction link buffer take a form of multi-layer elastomer buffers.

9. The device according to claim 1, wherein the rail car body with said stop plate is rotatable relative to the chassis about an axis of rotation which extends parallel to a vertical direction.

10. The device according to claim 1, wherein said traction link buffers have a base plate and are fixed by screwing said base plate to a cross-member of the chassis; and further comprising at least one adjustment insert disposed between the cross-member and said base plate.

* * * * *